United States Patent [19]

Grebe et al.

[11] Patent Number: 4,905,895

[45] Date of Patent: Mar. 6, 1990

[54] HEATING DEVICE, PARTICULARLY VEHICLE AUXILIARY HEATING DEVICE WITH A QUADRANGULAR HEAT EXCHANGER

[75] Inventors: Karl Grebe, Starnberg; Peter Glaser, Munich; Georg Baechle, Germering, all of Fed. Rep. of Germany

[73] Assignee: Webasto AG Fahrzeugtechnik, Gauting, Fed. Rep. of Germany

[21] Appl. No.: 318,645

[22] Filed: Mar. 3, 1989

[30] Foreign Application Priority Data

Mar. 4, 1988 [DE] Fed. Rep. of Germany ..... 3807189

[51] Int. Cl.[4] ..... B60H 1/02

[52] U.S. Cl. ..... 237/12.3 C; 126/110 B

[58] Field of Search ..... 237/12.3 C, 12.3 C, 237/32; 126/110 B, 110 D, 110 R

[56] References Cited

U.S. PATENT DOCUMENTS 4,395,225 7/1983 Mittmann .
4,624,218 11/1986 Baeuml et al. .

FOREIGN PATENT DOCUMENTS 3509349 9/1986 Fed. Rep. of Germany .
1409337 7/1965 France .

*Primary Examiner*—Henry A. Bennet
*Attorney, Agent, or Firm*—Sixbey, Friedman, Leedom & Ferguson

[57] ABSTRACT

In a heating device, particularly one intended for use as a vehicle auxiliary heating device, a heat exchanger is provided for a liquid heat exchange medium, which is of a quadrangular, preferably cuboid design, having a planar closed end. Inside the heat exchanger, inner fins are provided defining exhaust gas channels, whose free ends are approximately on a circle whose center is the center axis of the heat exchanger or that of the cylindrical combustion chamber as a transition between the cylindrical combustion chamber and a rectanguloid outer housing which surrounds the heat exchanger. An outer, flat surface of the housing may be formed with a receiver for a control or similar device. For optimizing the transfer of heat from the hot combustion gases at the inner side of the heat exchanger to the liquid heat exchange medium at the exterior of the heat exchanger, baffles are provided on the outer surface of the heat exchanger for guiding the liquid heat exchange medium in a manner which facilitates removal of steam or air bubbles therefrom and which adapts the flow of the liquid heat exchange medium to the heat flow at the respective surface of the heat exchanger.

20 Claims, 3 Drawing Sheets

HEATING DEVICE, PARTICULARLY VEHICLE AUXILIARY HEATING DEVICE WITH A QUADRANGULAR HEAT EXCHANGER

BACKGROUND OF THE INVENTION

The invention relates to a heating device, particularly a vehicle auxiliary heating device having a combustion chamber surrounded by a heat exchanger. Inner fins define exhaust gas channels at an inner surface of the heat exchanger, and the inner side of the heat exchanger surrounds the flow of hot combustion gases exiting from the combustion chamber. At its outer side. the heat exchanger is surrounded by a flow of a liquid heat exchange medium, such as a liquid coolant, water, or the like, that enters by an inlet, and leaves via an outlet, provided in a housing encasing the heat exchanger.

Heating devices operating with a gaseous heat exchange medium, like air, are referred to as so-called air heating devices. Examples of such devices are described in German Offenlegungsschrift No. 35 09 349 or French Pat. No. 1,409,337. In such air heating devices it is known to provide a heat exchanger in which the contour formed by outwardly directed longitudinal fins (i.e., the locus of points formed by the free ends of the fins) is rectangular, quadrangular or of similar shape. In the air heating device of French Pat. 1,409,337, the heat exchanger is of a cuboid configuration, while an inner cavity of the heat exchanger through which the hot combustion gases travel is rectanguloid and contains inwardly directed fins which define exhaust gas channels. However, a closed end of this heat exchanger, at which the flow of exhaust gases is reversed, is curved, i.e., it is cross-sectionally a hemi-spherical configuration.

In contrast thereto, heating devices operated with a liquid heat exchange medium, like a liquid coolant, water, or the like, referred to as so-called water heating devices, are known. Conventionally, water heating devices have been provided with hollow cylindrical heat exchangers for the purpose of obtaining uniform flow penetration and flow circulation of the liquid heat exchange medium through the heat exchanger. U.S. Pat. No. 4,624,218 is an example of a water heating device and has heat exchanger fins extending radially from its inner surface, the free ends of which are disposed along a circle having the center axis of the combustion chamber as its center. A liquid heat transfer medium enters an annular flow-through space between the heat exchanger and an outer housing (formed by integrally joined inner and outer jackets) in proximity to a closed end of the heat exchanger and exits via an outlet near the opposite end thereof. Furthermore, in one embodiment, the housing has a quadrangular exterior shape, although it is internally cylindric. Another example of a water heater is shown in U.S. Pat. No. 4,395,225. The heater shown there has an outwardly projecting helical fin on an outer surface of the heat exchanger, and, again, the liquid heat transfer medium enters in proximity to the closed end of the heat exchanger and exits at the opposite end thereof.

SUMMARY OF THE INVENTION

It is the primary objective of the present invention to provide a heating device of the kind described which yields an improved heat exchange, using a liquid heat exchange medium, while offering the smallest possible construction size.

In accordance with a preferred embodiment of the invention, a heating device, particularly a vehicle auxiliary heating device, having a combustion chamber surrounded by a heat exchanger with inner fins that form exhaust gas channels in an inner cavity thereof through which hot combustion gases exiting from the combustion chamber flow, and about which a liquid heat exchange medium flows between an inlet and an outlet that are provided in a housing surrounding the heat exchanger, wherein the heat exchanger has an outer contour, over which the liquid heat exchange medium flows, of an approximately quadrangular shape having a planar closed end.

The use of a heating device employing a quadrangular-shaped heat exchanger yields a significant increase of the fin surfaces which are exposed to the heat of the hot combustion gases so that the transference of heat from the heat exchanger to the liquid heat exchange medium can be undertaken more effectively. Due to the fact that the closed end of the heat exchanger of the inventive heating device has a planar surface instead of a spherical surface as in the conventional heat exchanger, heat exchange at the closed end area of the heat exchanger can also be substantially improved. Furthermore, larger flow cross sections, defined by the fins, can be realized, so that pressure occurring at the heat exchanger can be substantially reduced.

Another advantage is that in the inventive heating device, the heat exchanger also is of compact design and, accordingly, is utilized to optimum advantage, in that a small space is made to yield a greater efficiency in the heat exchange between the hot combustion gases and the liquid heat exchange medium. Preferably, the quadrangular outer contour circumscribes a square, so that the heat exchanger, in its entirety, has a cuboid configuration.

In order to adapt the inner fins of the heat exchanger, which define interior exhaust gas channels, to the shape of the combustion chamber, the inner fins are designed such that the locus of points formed by their free ends approximately form a circle whose center corresponds to the center axis of the heat exchanger and/or that of the heating device. Accordingly, the interior of the heat exchanger is of a configuration which is adapted to the circular form of the combustion chamber, with the result that the heat exchanger of the inventive heating device achieves a transformation from a circular form to a cuboid form while maintaining the integrity of its compactness.

In order to achieve a heat distribution which is as uniform as possible across the circumference of the heat exchanger, the inner fins, preferably, are of different lengths and/or thicknesses.

In accordance with another preferred feature of the invention, the housing surrounding the heat exchanger also has an approximately quadrangular, preferably quadrate, outer contour, with the result that the inventive heating device, unlike those of conventional design, also has a cuboid outer shape, with inherent advantages regarding installation and arrangement of additional devices. As a result, the compactness of such heating devices, as a whole, can be improved.

Preferably, at least one of the flat outer surfaces of the quadrangular housing serves to accommodate additional devices, like a control device, or the like. To this end, it is possible to form corresponding recesses for such devices directly on the exterior of the housing, eliminating the need for additional holding components.

Moreover, the heating device in accordance with the invention is designed in such a manner that, preferably, at another surface of the quadrangular housing, the inlet and outlet for the liquid heat exchange medium are provided. If desired, an exhaust gas outlet and/or fuel inlet, or combustion air inlet can be disposed at this outer surface. Preferably, this flat outer surface is diametral to that of the outer surface at which the additional device, like the control device, is to be located. A configuration of this type facilitates ease of installation of such a heating device into a motor vehicle.

In accordance with another aspect of the inventive heating device, baffles are provided at the outer side of the heat exchanger in order to disperse the flow of liquid heat exchange medium through the heat exchanger in order to direct the flow onto the respective surfaces of the heat exchanger in accordance with different degrees to which they are heated. Due to the fact that the inlet and the outlet for the liquid heat exchange medium are provided at the same surface, in a further development of the invention, the baffle plates also serve to direct the liquid heat exchange medium across the heat exchanger in a manner such that flow paths are realized which are as long as possible for improvement of the efficiency of the heat exchanger.

In accordance with a preferred embodiment of the invention, the baffles are arranged such that, after entry of the liquid heat exchange medium via the inlet, most of it is directed to the surface of the planar closed end of the heat exchanger, which is located at a point of the heating device at which the hot combustion gases exiting from the combustion chamber are deflected so as to reverse their flow direction, prior to their sweeping over the heat exchanger. Consequently, the closed end surface of the heat exchanger is one of the hottest zones, at which the highest temperature difference is present between the liquid heat exchange medium and hot exhaust gases, so that this surface is of utmost importance with regard to the efficiency of the heat exchanger.

Preferably, the inventive construction is such that opposite side surfaces of the heat exchanger, which do not include the surface at the points entry and exit of the liquid heat exchange medium, have baffle plates defining approximately parallel channels extending in the axial direction of the heat exchanger. These construction measures, together with the configuration of the baffles, ensure that steam bubbles, which might form in the liquid heat exchanger, are effectively passed to the exit, thereby precluding their impairing the heat exchange at the heat exchanger. Consequently, the baffles in the inventive heat exchanger further serve the purpose to support so-called "forced ventilation" of the liquid heat exchange medium circulation in the heating device.

Preferably, the height and/or width of the channels defined by the baffles are changeable for varying the flow resistance for the purpose of adaptation of the liquid flow to the heat flow. As a consequence thereof, the baffles of the heat exchanger can be designed such that the flow of the liquid heat exchange medium at the heat exchanger can be correspondingly correlated to the surfaces having differing heat flows. Also, the lengths of the channels defined by the baffles can be varyingly selected.

In order to prevent a direct flow-through from the inlet to the outlet of the heat exchanger, at least one baffle is provided which forms a dividing wall between the inlet and the outlet of the liquid heat exchange medium at the heat exchanger. This dividing wall baffle extends at least across two adjacent surfaces of the quadrangular heat exchanger. Accordingly, corresponding arrangements of the baffles in accordance with the invention result in optimizing the path of the liquid heat carrier at the heat exchanger, with the purpose of obtaining the most efficient heat transfer possible from the hot combustion gases to the liquid heat carrier.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
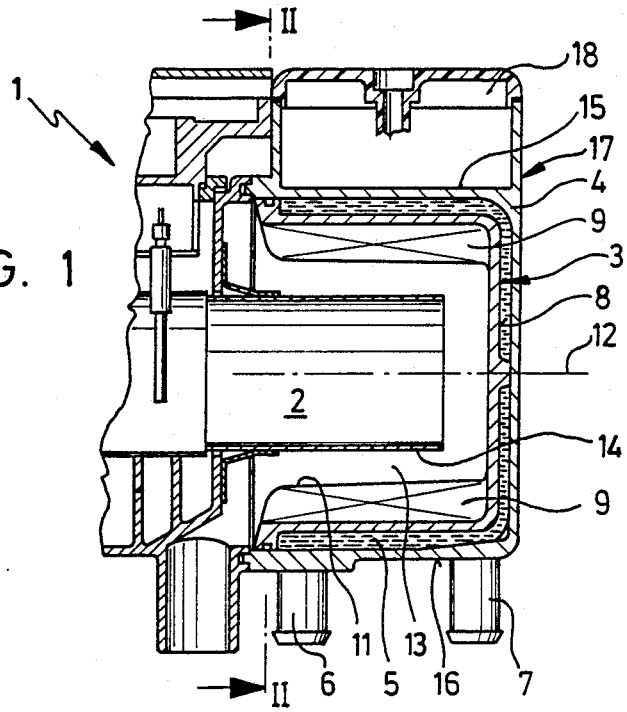
FIG. 1 is a schematic sectional view of a heating device in accordance with a preferred embodiment of the invention.

FIG. 1 schematically depicts a heating device, designated in its entirety with reference numeral 1, which serves, for example, as an auxiliary vehicle heating device. Heating device 1 is powered by liquid fuel and has a combustion chamber 2 in which a fuel/air mixture is burned. The combustion chamber is surrounded by a heat exchanger 3 whose inner surface is swept over by the hot combustion gases produced in the combustion chamber 2 during the combustion process. Heat exchanger 3 is encased in a housing 4, of heating device 1, whereby a gap is formed between the outer surface of the heat exchanger 3 and inner surface of the housing 4 which serves as a flow-through space for a liquid heat exchange medium 5, such as the liquid coolant or water in a motor vehicle. The liquid heat exchange medium 5 enters housing 4 via an inlet 6 and exits housing 4 via an outlet 7.

Figure 2:
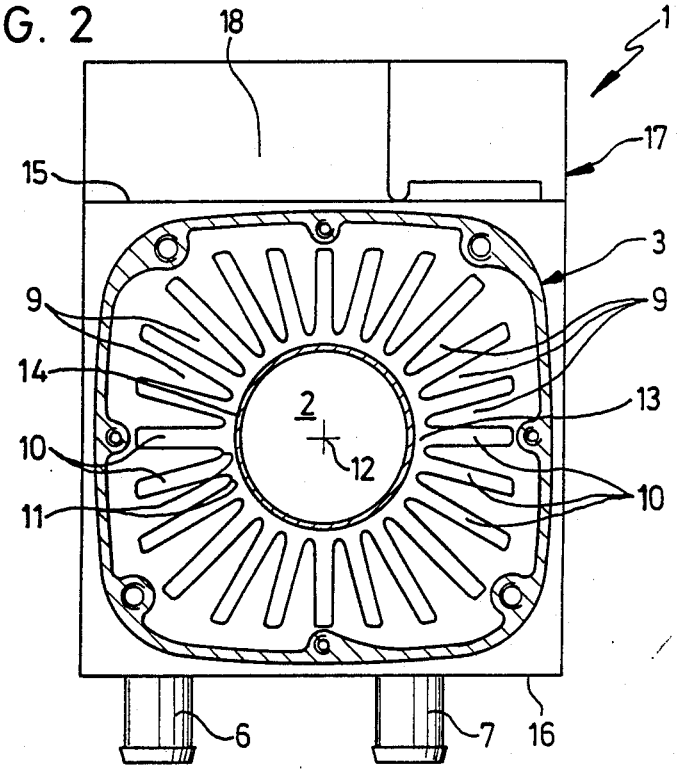
FIG. 2 is a schematic sectional view through the inventive heating device taken along line II—II in FIG. 1.
Figure 3:
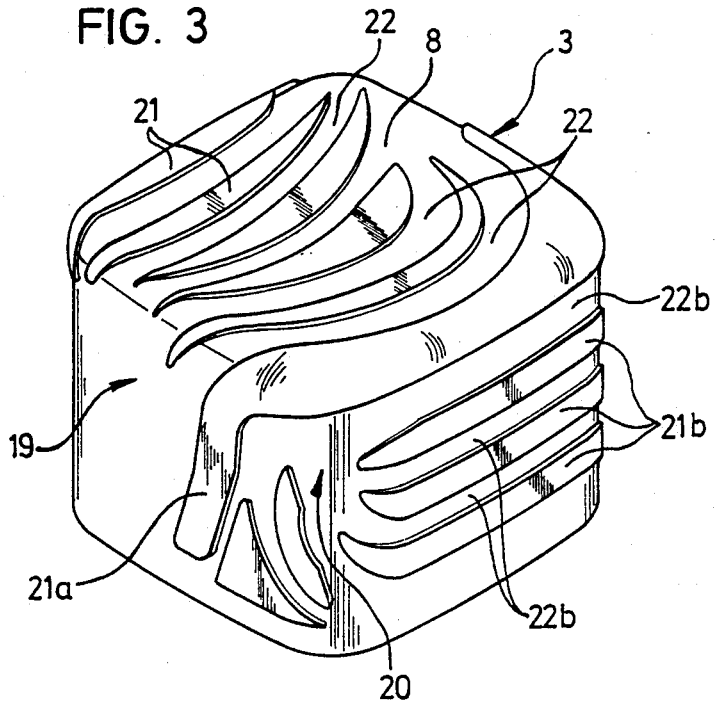
FIGS. 3 and 4 are perspective views of the heat exchanger in the inventive heating device.
Figure 4:
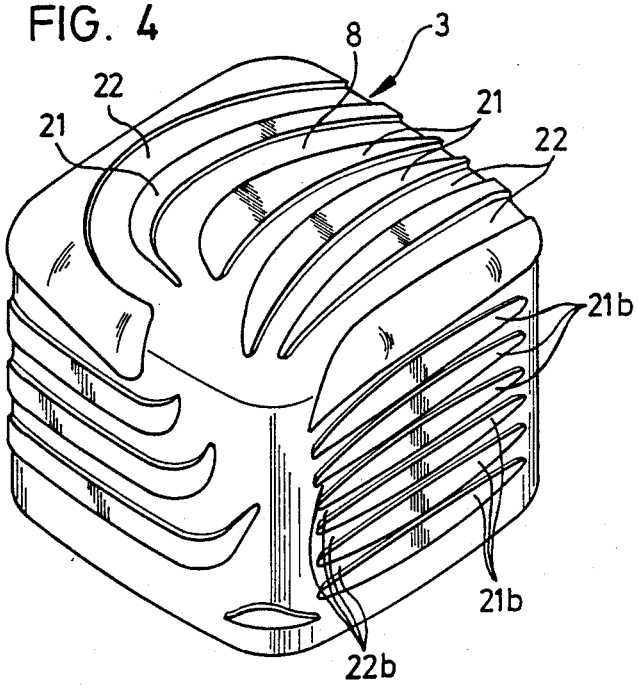

As can be seen from FIG. 2, in combination with FIGS. 3 and 4, heat exchanger 3 has an approximately quadrangular outer contour with a planar closed end 8. The cross-sectional view of the heating device 1 and the heat exchanger 3, in FIG. 2, show that heat exchanger 3 has inner fins 9 which define exhaust gas channels 10. Inner fins 9 extend essentially radially inwardly and terminate so that their free ends 11 are located on a circle whose center approximately represents the center axis 12 of heat exchanger 3 and of the combustion chamber 2 of the heating device. Accordingly, the free ends 11 of inner fins 9 define an inner space 13 of approximately circular cross section in heat exchanger 3. Inner space 13 accommodates combustion chamber 2, which is defined by a combustion pipe 14, for example. As can be further seen from FIG. 2, inner fins 9, viewed radially, are of varying lengths and also can be of different thickness.

As can be seen from the configuration of the heat exchanger 3 depicted in FIG. 2, the surface area formed by inner fins 9, together with the surface of closed end 8. is substantially larger than that of a heat exchanger with a circular cross section, and the fin surface area can be expanded up to 100% over that of one with a circular cross section. Inasmuch as closed end 8 also has a larger surface area in comparison to the spherically or circularly shaped closed end of conventional heat exchangers, an interaction with the inventive heat exchanger 3 results in an essentially better heat transfer, so that the efficiency of heat exchanger 3 can be considerably improved. Accordingly, the exhaust gas channels defined by inner fins 9, in this manner, form favorable flow cross sections enabling the heat exchanger 3 to operate with a lower pressure than has been previously possible.

FIGS. 1 and 2 of the drawings further show that housing 4 also has a quadrangular outer contour which appropriately circumscribes a square. As a result, the outer side of housing 4 has flat outer surfaces 15, 16, the other pair of opposite outer surfaces (at the side areas of the circumscribed quadrangle) not being designated by numerals. At outer surface 15, at the top in the example depicted, a receiving means 17 is formed directly onto the body of housing 4, and serves, for example, for receiving a control device 18 that is not depicted in detail. In this way, the control device 18 can be installed directly into the body of housing 4, so that additional holding or mounting components for such a control device are not necessary.

The inlet 6 and outlet 7 of housing 4 for the liquid heat exchange medium are provided on outer surface 16, opposite outer surface 15. An exhaust gas outlet connection and/or corresponding supply line means for the fuel and/or the combustion air can also be provided at outer surface 16. Accordingly, all elements of the heating device 1 leading to the outside are arranged on one side, i.e., on flat outer surface 16 of housing 4, in order to facilitate installation of heating device 1.

Figure 5:
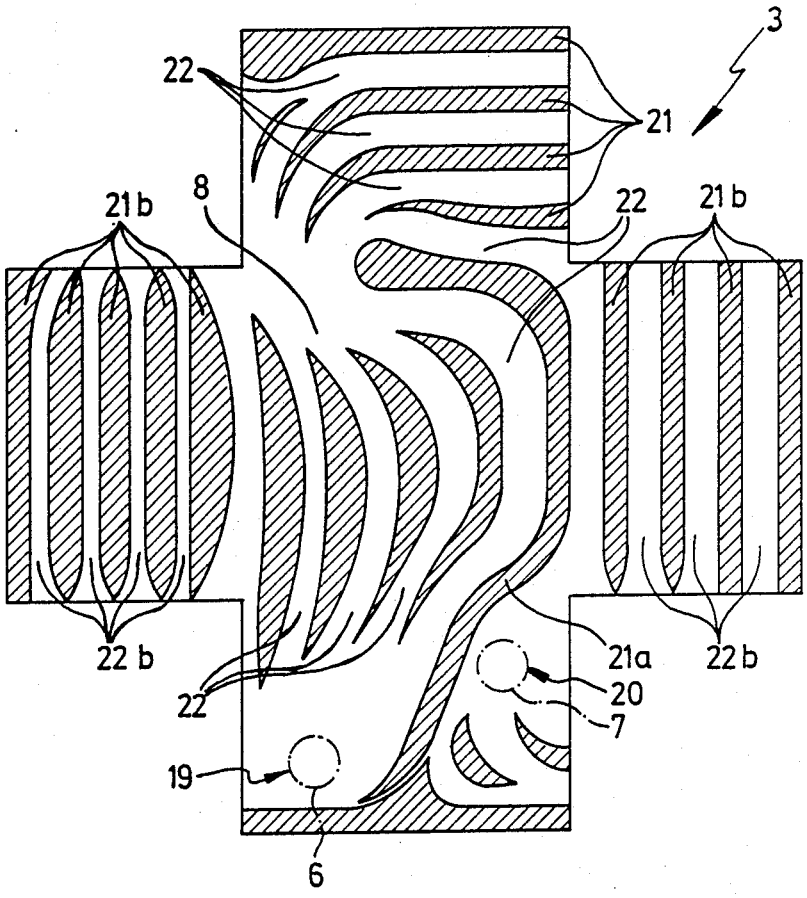
FIG. 5 is a layout projection view of the outer surfaces of the heat exchanger shown in FIGS. 3 and 4.

FIGS. 3 through 5 depict details of the exterior of heat exchanger 3, i.e., that side of heat exchanger 3 over which the liquid heat exchange medium 5 flows. In particular, FIG. 3 shows a perspective view onto heat exchanger 3 in a direction towards the inlet area 19, formed opposite inlet 6, and towards outlet area 20, formed opposite outlet 7. FIG. 4 shows heat exchanger 3 in a direction which is opposite that shown in FIG. 3, i.e., looking onto the wall surface opposite that having inlet area 19 and outlet area 20.

As shown in the drawings, there are various baffles 21 on the exterior wall surfaces of heat exchanger 3, which form flow paths for the liquid heat exchange medium that can be seen in greater detail in FIG. 5. In particular, channels 22 are defined between each pair of adjacent baffle plates 21 for guiding the flow of liquid heat exchange medium 5. Starting from inlet area 19 (see FIGS. 3 and 5), the baffles 21 are designed such that a major portion of the flow of the liquid heat exchange medium entering via inlet area 19 (about 80% thereof, for example) is passed directly to the closed end 8 of the heat exchanger 3. The remaining 20% of the flow of the liquid heat exchange medium passes to the outer wall surfaces of heat exchanger 3. Thus, the major portion of the flow reaches outlet area 20 only after it has passed over the closed end 8 of heat exchanger 3 via corresponding channels formed by the baffles. In particular, starting at inlet area 19, one of the baffles, designated **21*a*, extends at least across two surfaces of heat exchanger 3 (see FIG. 5) and forms a divider between inlet area 19 and outlet area 20, thereby preventing the incoming heat carrier flow from reaching outlet area 20 directly, and instead, forcing it to flow across the closed end 8 and/or the side wall surfaces of heat exchanger 3**, first.

The baffles **21*b*, disposed to the left and right in FIG. 5, are on opposite sides of closed end 8 and the surface having areas 19, 20 of the heat exchanger 3. These baffle plates 21*b* have such a configuration that they define channels 22*b* which extend in a direction that is approximately parallel to each other and the axial direction of the heater. As can also be seen from the drawings, the width and/or the height of baffles 21, 21*a*, 21*b* can be varied such that the channels 22, 22*b* can be given varying cross sections for causing the flow resistances to be altered due to the effects of baffles 21, 21*a*, 21*b*. In this way, the flow of the liquid heat exchange medium can be coordinated to the heat flow from the exhaust gases into the various areas of the heat exchanger 3 with a resultant improvement in the efficiency of the heat transfer from the gases to the liquid heat exchange medium at heat exchanger 3**.

Moreover, the baffles 21, **21*a*, 21*b* are formed such that, in the manufacture of heat exchanger 3 as a cast part, the easiest possible removal of the cast piece from the mold is facilitated. Further, it is to be understood that the invention is not limited to the embodiment illustrated and described, with reference to the design and configuration of the baffles 21, 21*a* 21*b* and can utilize other arrangements which meet the objectives sought by the invention, i.e., to effectively remove air and steam bubbles from the liquid heat exchange medium 5, and to effect a flow thereof in such a manner as to adapt the flow of liquid onto those surfaces of heat exchanger 3** in proportion to differing flows of heat thereto.

It is still further to be understood that essentially parallel channels **22*b* can have different lengths, and that, in each case, the person skilled in the art will arrange the baffles 21, 21*a*, 21*b* to optimize their effect. The baffles 21, 21*a*, 21*b* can have dimensions which differ from those shown described herein, essentially based on the dimensions of heat exchanger 3, relative to the output required by the respective heating device 1**.

While we have shown and described a single embodiment in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

What is claimed is:

1. A heating device, particularly a vehicle auxiliary heating device, having a combustion chamber that is surrounded by a heat exchanger, said heat exchanger having inner fins that form exhaust gas channels through which a flow of hot combustion gases exiting the combustion chamber are passed, and a housing surrounding the heat exchanger with a flow-through space for a flow of a liquid heat exchange medium between an inlet and an outlet of the housing being defined between the housing and the heat exchanger; wherein the heat exchanger has an approximately quadrangular outer contour with a planar closed end wall.

2. A heating device according to claim 1, wherein the quadrangular outer contour has a quadrate configuration.

3. A heating device according to claim 2, wherein the heat exchanger, as a whole, has a cuboid configuration.

4. A heating device according to claim 1, wherein the inner fins have free ends which are located approximately on a circle whose center is represented by a center axis of the heat exchanger.

5. A heating device according to claim 4, wherein the inner fins have differing lengths.

6. A heating device according to claim 5, wherein the inner fins have differing thicknesses.

7. A heating device according to claim 4, wherein the inner fins have differing thicknesses.

8. A heating device according to claim 1, wherein said housing has an approximately quadrangular configuration.

9. A heating device according to claim 8, wherein said housing has a flat outer surface upon which is formed a receiving means for accommodating at least one additional device.

10. A heating device according to claim 8, wherein said additional device is a control device.

11. A heating device according to claim 10, wherein said housing is provided with another flat outer surface on which said inlet and outlet for the flow of liquid heat exchange medium are provided.

12. A heating device according to claim 11, wherein an exhaust gas outlet is provided on the same flat outer surface of the housing as said inlet and outlet.

13. A heating device according to claim 11, wherein the flat outer surface having said inlet and outlet for the liquid heat exchange medium is located diametrically opposite the outer surface which has said receiving means for accommodating at least one additional device.

14. A heating device according to claim 1, wherein the exterior of said heat exchanger is provided with baffles for guiding the flow of liquid heat exchange medium thereover.

15. A heating device according to claim 14, wherein said baffles are constructed so as to cause a major portion of the flow of liquid heat exchange medium entering via said inlet to be guided from an inlet area of a wall surface of the heat exchanger over the closed end surface of the heat exchanger before enabling it to reach an outlet wall surface area.

16. A heating device according to claim 15, wherein side surfaces of the heat exchanger, which are on opposite sides of said closed end and of said inlet and outlet wall surface areas, have baffles that define approximately parallel channels that extend in an axial direction of the heat exchanger.

17. A heating device according to claim 16, wherein at least one of the height and width of said channels defined by the baffles varies as a means for varying flow therethrough in proportion to the flow of heat to a corresponding area of the heat exchanger.

18. A heating device according to claim 17, wherein at least one of said baffles forms a dividing wall between said inlet and outlet areas, said wall extending across at least two adjacent surfaces of the heat exchanger.

19. A heating device according to claim 16, wherein at least one of said baffles forms a dividing wall between said inlet and outlet areas, said wall extending across at least two adjacent surfaces of the heat exchanger.

20. A heating device according to claim 15, wherein at least one of said baffles forms a dividing wall between said inlet and outlet areas, said wall extending across at least two adjacent surfaces of the heat exchanger.

* * * * *